US012065812B2

(12) United States Patent
Currey et al.

(10) Patent No.: US 12,065,812 B2
(45) Date of Patent: Aug. 20, 2024

(54) DUAL HANDLE CENTER MOUNTED FAUCET

(71) Applicant: Delta Faucet Company, Indianapolis, IN (US)

(72) Inventors: Don Currey, Chagrin Falls, OH (US); Scott Gardner, Chagrin Falls, OH (US); Kyle Meehan, Fishers, IN (US); Alisha Buescher, Jamestown, IN (US)

(73) Assignee: Delta Faucet Company, Indianapolis, IN (US)

( * ) Notice: Subject to any disclaimer, the term of this patent is extended or adjusted under 35 U.S.C. 154(b) by 77 days.

(21) Appl. No.: 17/676,463

(22) Filed: Feb. 21, 2022

(65) Prior Publication Data

US 2022/0290417 A1 Sep. 15, 2022

Related U.S. Application Data

(60) Provisional application No. 63/160,360, filed on Mar. 12, 2021.

(51) Int. Cl.
*E03C 1/04* (2006.01)

(52) U.S. Cl.
CPC ..... *E03C 1/0402* (2013.01)

(58) Field of Classification Search
CPC .... E03C 1/0401; E03C 1/0402; E03C 1/0403; E03C 1/0404
See application file for complete search history.

(56) References Cited

U.S. PATENT DOCUMENTS

| | | | | |
|---|---|---|---|---|
| 5,669,417 | A * | 9/1997 | Lian-Jie | E03C 1/0404 137/606 |
| 6,381,776 | B1 | 5/2002 | Wang | |
| 6,401,748 | B1 * | 6/2002 | Wang | E03C 1/0401 137/359 |
| 7,698,755 | B2 * | 4/2010 | McNerney | E03C 1/0401 4/695 |
| 8,689,818 | B2 | 4/2014 | Marty et al. | |
| 8,695,625 | B2 * | 4/2014 | Marty | E03C 1/0401 137/315.12 |
| 8,931,500 | B2 * | 1/2015 | Thomas | F16K 19/006 4/678 |
| 9,309,976 | B2 | 4/2016 | Marty et al. | |
| 2014/0115775 | A1 | 5/2014 | McNicholas | |
| 2014/0310869 | A1 | 10/2014 | McNicholas | |

FOREIGN PATENT DOCUMENTS

| | | |
|---|---|---|
| GB | 2462542 A | 2/2010 |
| KR | 20110009190 U | 9/2011 |

* cited by examiner

*Primary Examiner* — Erin Deery
(74) *Attorney, Agent, or Firm* — Bose McKinney & Evans LLP

(57) ABSTRACT

A faucet assembly and related mounting method is disclosed. The faucet assembly requires only a single fastening mechanism to secure the faucet assembly to a mounting deck. Locating members positioned in alignment with fluid source pipes and their corresponding valves ensure proper placement of the faucet assembly relative to the mounting deck.

10 Claims, 12 Drawing Sheets

DUAL HANDLE CENTER MOUNTED FAUCET

CROSS-REFERENCE TO RELATED APPLICATION

The present application claims priority to U.S. Provisional Patent Application Ser. No. 63/160,360, filed Mar. 12, 2021, the disclosure of which is expressly incorporated herein by reference.

BACKGROUND AND SUMMARY OF THE DISCLOSURE

The present disclosure relates to faucets. Specifically, the present disclosure relates to a structure and related method for mounting dual handle faucets.

Installation of a faucet requires mounting of the faucet to a mounting surface, typically a counter or sink deck adjacent to a basin. Conventional mounting hardware for dual handle faucets (e.g., centerset faucets) typically include two mounting shanks to facilitate installation of a first valve assembly (including a first handle) of the faucet with a corresponding hot water source, and a second valve assembly (including a second handle) of the faucet with a corresponding cold water source. However, such installation methods can be complicated, require substantial time, and/or require multiple components. A cost effective, simpler, and more secure solution for mounting a faucet is desired.

A faucet assembly and corresponding mounting method is disclosed. The illustrative faucet assembly requires only a single fastening mechanism to secure the faucet assembly to a mounting deck. Illustrative locating members positioned in alignment with fluid source pipes and their corresponding valves add security and ensure proper placement of the faucet assembly relative to the mounting deck.

According to an illustrative embodiment of the present disclosure, a faucet assembly includes an escutcheon, a first handle rotatably supported above the escutcheon, a second handle rotatably supported above the escutcheon in spaced relation to the first handle, and a spout extending above the escutcheon intermediate the first handle and the second handle. A mounting fastener includes a proximal fastener head and a distal fastener shaft, the fastener head received within an interior space of the escutcheon, and the fastener shaft extending below the escutcheon. A retainer receives the fastener head to prevent rotation between the mounting fastener and the escutcheon. A waterway assembly is received within the escutcheon, the waterway assembly being configured to deliver fluid from a first valve operably coupled to the first handle to the spout, and from a second valve operably coupled to the second handle to the spout. The mounting fastener is configured to couple to a mounting nut to secure the faucet assembly to a mounting deck during installation.

According to a further illustrative embodiment of the present disclosure, a faucet assembly includes an escutcheon supported below a first handle, a second handle, and a spout. A mounting base is removably coupled to the escutcheon, the mounting base including a first locating member extending below the mounting base, and a second locating member extending below the mounting base in spaced relation to the first locating member. A mounting fastener is supported by the mounting base and extends below the mounting base. The first locating member, the second locating member and the center mounting fastener are configured to be received by respective mounting openings defined by a mounting deck during installation.

According to another illustrative embodiment of the present disclosure, a method of installing a faucet includes disposing a mounting fastener within a through hole of a mounting base of a faucet assembly, coupling the mounting base to an escutcheon, aligning a first locating member of the mounting base with a first mounting hole defined by a mounting deck, aligning a second locating member of the mounting base with a second mounting hole defined by the mounting deck, and aligning the mounting fastener with a third mounting hole defined by the mounting deck. The method further includes inserting the first locating member into the first mounting hole, the second locating member into the second mounting hole, and the mounting fastener into the third mounting hole, and threadably coupling a center mounting nut to the center mounting fastener.

Additional features and advantages of the present disclosure will become apparent to those skilled in the art upon consideration of the following detailed description of the illustrative embodiments exemplifying the disclosure as presently perceived.

BRIEF DESCRIPTION OF THE DRAWINGS

The detailed description of the drawings particularly refers to the accompanying figures in which.

Figure 1:
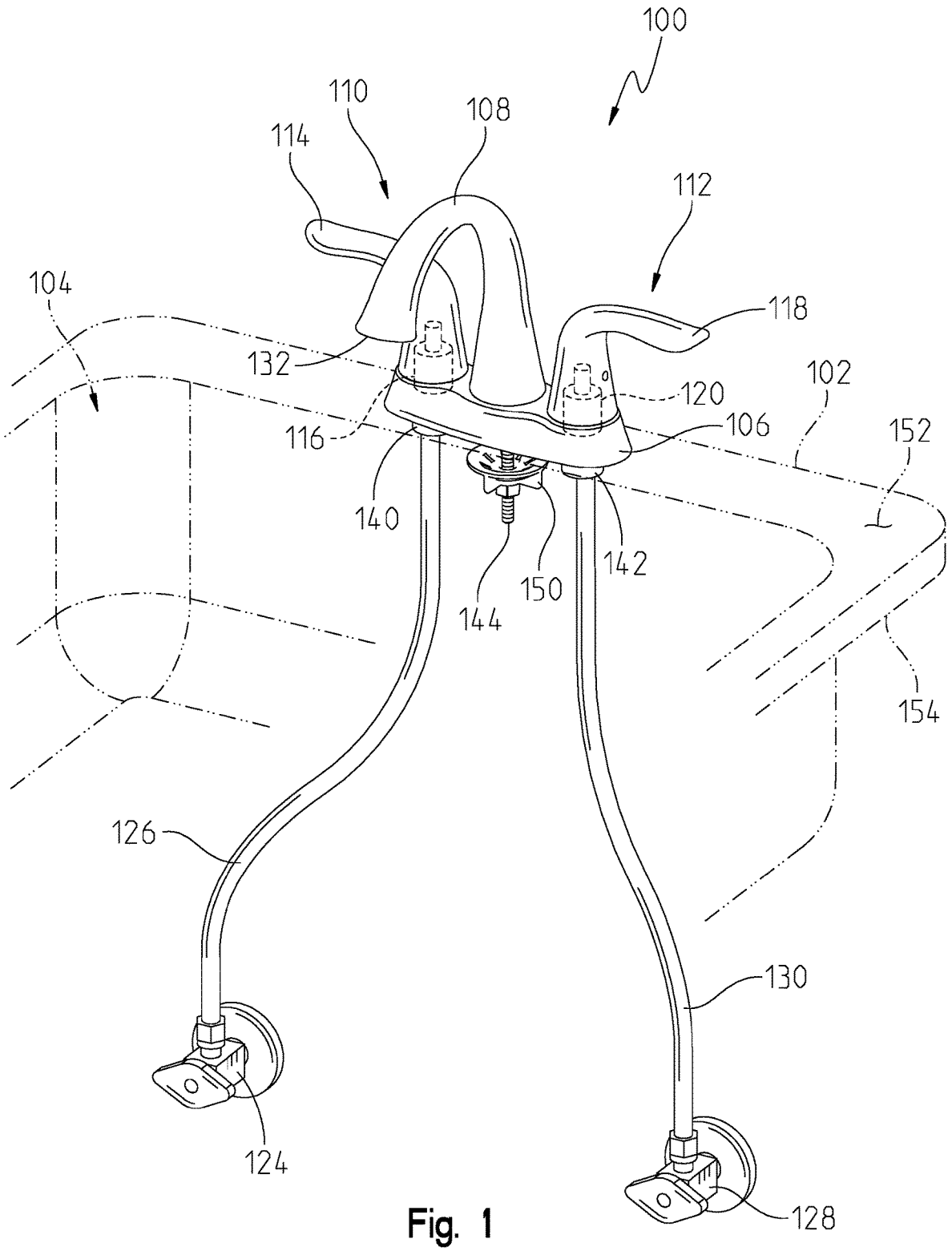
FIG. 1 is a perspective view of an illustrative faucet assembly of the present disclosure mounted to a mounting deck and coupled to a fluid source for operation.

Corresponding reference characters indicate corresponding parts throughout the several views. Although the drawings represent embodiments of various features and components according to the present disclosure, the drawings are not necessarily to scale and certain features may be exaggerated in order to better illustrate and explain the present disclosure. The exemplification set out herein illustrates an embodiment of the invention, and such an exemplification is not to be construed as limiting the scope of the invention in any manner.

DETAILED DESCRIPTION OF THE DRAWINGS

The embodiments of the disclosure described herein are not intended to be exhaustive or to limit the disclosure to the precise forms disclosed. Rather, the embodiments described herein enable one skilled in the art to practice the disclosure.

Figure 2:
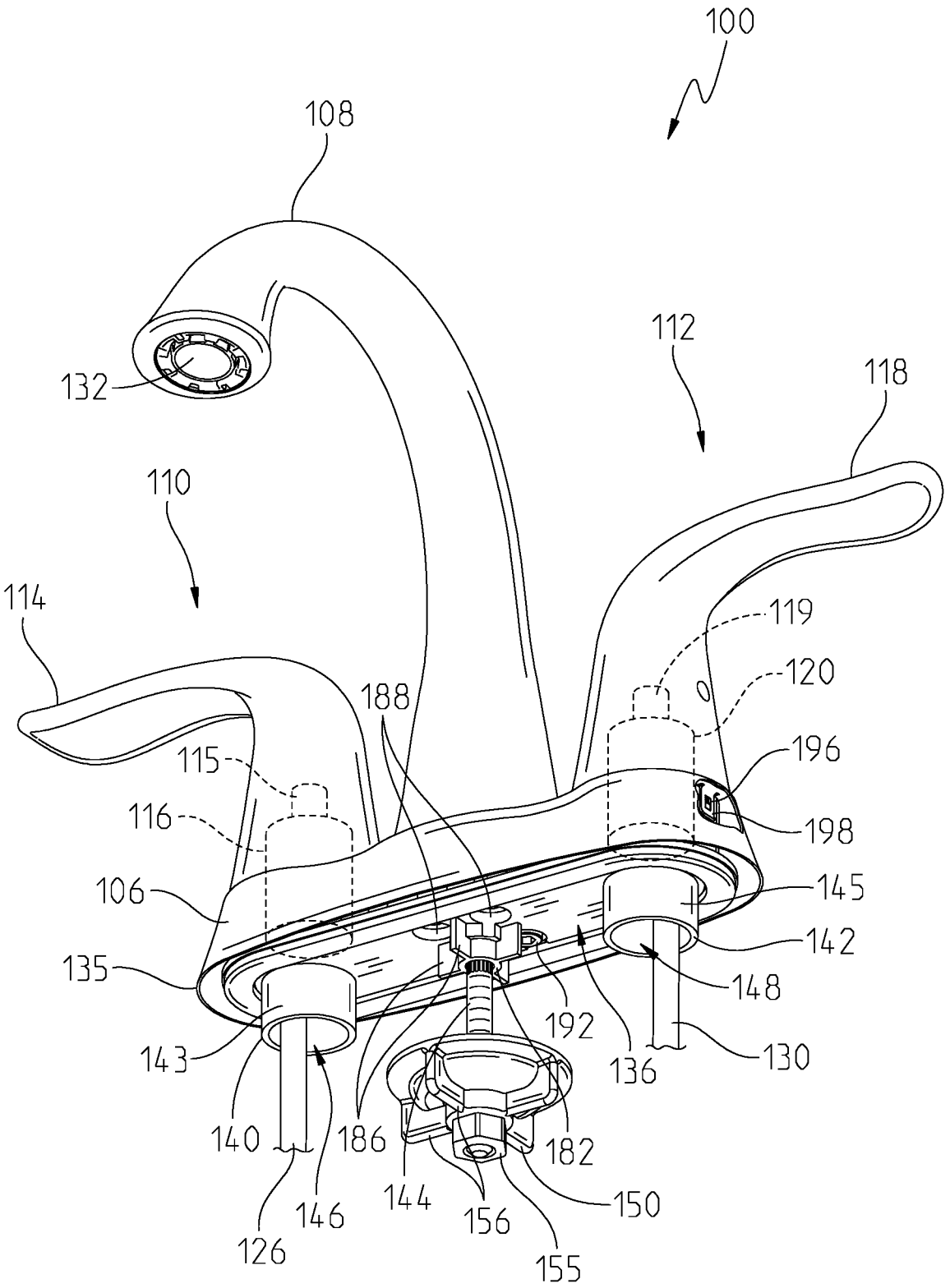
FIG. 2 is a bottom perspective view of the faucet assembly of FIG. 1, including a view of a mounting base of the faucet assembly and accompanying mounting hardware for mounting the faucet assembly to the mounting deck.

Referring initially to FIGS. 1 and 2, an illustrative faucet assembly 100 of the present disclosure is illustrated. The faucet assembly 100 is mounted to a mounting deck 102, illustratively a sink deck, adjacent to a basin 104. The illustrative faucet assembly 100 includes an escutcheon 106, a spout 108, a first valve assembly 110, and a second valve assembly 112. Illustratively, the first valve assembly 110 includes a first handle 114 rotatably coupled to a valve stem 115 of a first valve cartridge 116, and the second valve assembly 112 includes a second handle 118 rotatably coupled to a valve stem 119 of a second valve cartridge 120. An illustrative valve assembly may be of the type shown in U.S. Pat. No. 9,309,976 to Marty et al., the disclosure of which is expressly incorporated herein by reference.

The illustrative faucet assembly 100 is of the type commonly referred to as a centerset faucet. The first handle 114 and the second handle 118 are rotatably supported above the escutcheon 106 so that the first handle 114 and the second handle 118 are configured to rotate relative to the escutcheon 106 and the mounting deck 102 when mounted. In some illustrative embodiments, the spout 108 may also be rotatable relative to the escutcheon 106 and the mounting deck 102.

Referring further to FIGS. 1 and 2, the first valve assembly 110 is fluidly coupled to a first fluid source 124, illustratively a hot water source such as a hot water valve stop. A first source pipe 126 (e.g., a flexible tube formed of a polymer, such as cross-linked polyethylene (PEX)) fluidly couples the first fluid source 124 to the faucet assembly 100 as described further herein. The second valve assembly 112 is operably coupled to a second fluid source 128, illustratively a cold water source such as a cold water valve stop. A second source pipe 130 (e.g., a flexible tube formed of a polymer, such as cross-linked polyethylene (PEX)) fluidly couples the second fluid source 128 to the faucet assembly 100 as described further herein. The faucet assembly 100 is arranged so that actuation of the first valve assembly 110 via rotation of the first handle 114 permits fluid flow from the first fluid source 124 through the spout 108 and through an outlet 132 of the spout 108. Similarly, actuation of the second valve assembly 112 via rotation of the second handle 118 permits fluid flow from the second fluid source 128 through the spout 108 and through an outlet 132 of the spout 108. The outlet 132 may be defined by a conventional aerator.

Referring to FIGS. 3-6, the escutcheon 106 illustratively includes a sidewall 135 configured to receive a mounting base 136. Illustratively, the escutcheon 106 is formed of a metal, such as stamped brass or stainless steel. The illustrative mounting base 136 may be formed of a polymer and includes a retainer, illustratively a center retention cavity 138 positioned intermediate a first locating member 140 and a second locating member 142. The retention cavity 138 receives a mounting fastener 144. The first locating member 140 and the second locating member 142 each illustratively include a cylindrical wall 143, 145 defining an opening 146, 148 to receive the first source pipe 126 and the second source pipe 130, respectively, to facilitate coupling of the first fluid source 124 and the second fluid source 128 to the faucet assembly 100.

The center mounting fastener 144 may comprise a screw, a bolt, a pin, or another mechanical fastener formed of a metal. As illustrated, the center mounting fastener 144 is preferably threaded to receive a center mounting nut 150. More particularly, the center mounting fastener 144 illustratively includes a proximal head 147 and a distal threaded shaft 149.

Figure 3:
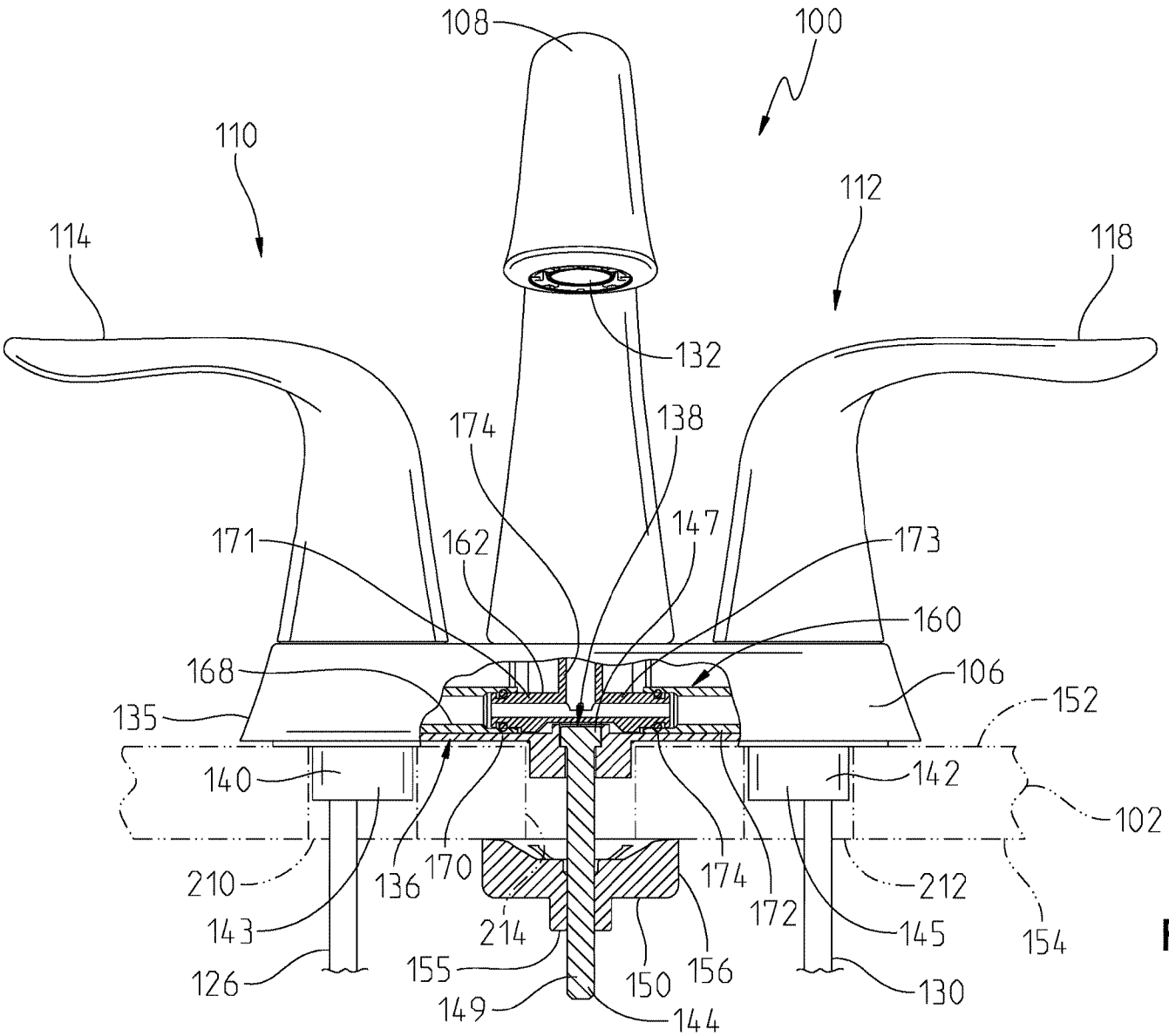
FIG. 3 is a partial cross-sectional front view of the faucet assembly of FIG. 2, taken along line 3-3 of FIG. 2, with the mounting deck shown in phantom.

When mounted, as shown in FIGS. 1 and 3, the escutcheon 106 and the mounting base 136 are coupled together and positioned on a top surface 152 of the mounting deck 102. The center mounting fastener 144, the first locating member 140, and the second locating member 142 are illustratively disposed through the mounting deck 102 and extend beyond a bottom surface 154 of the mounting deck 102. The first locating member 140 and the second locating member 142 facilitate proper positioning of the escutcheon 106 and the mounting base 136 relative to the mounting deck 102, while allowing passage of the first source pipe 126 and the second source pipe 130 through the mounting deck 102 to the faucet assembly 100. The center mounting fastener 144 threadably receives the center mounting nut 150 to secure the faucet assembly 100 to the mounting deck 102. The illustrative mounting nut 150 includes a threaded portion 155 threadably coupled with the shaft 149 of the fastener 144. The center mounting nut 150 may include gripping ridges or tabs 156 to assist with screwing the center mounting nut 150 onto the threaded shaft 149 of the center mounting fastener 144.

Figure 4:
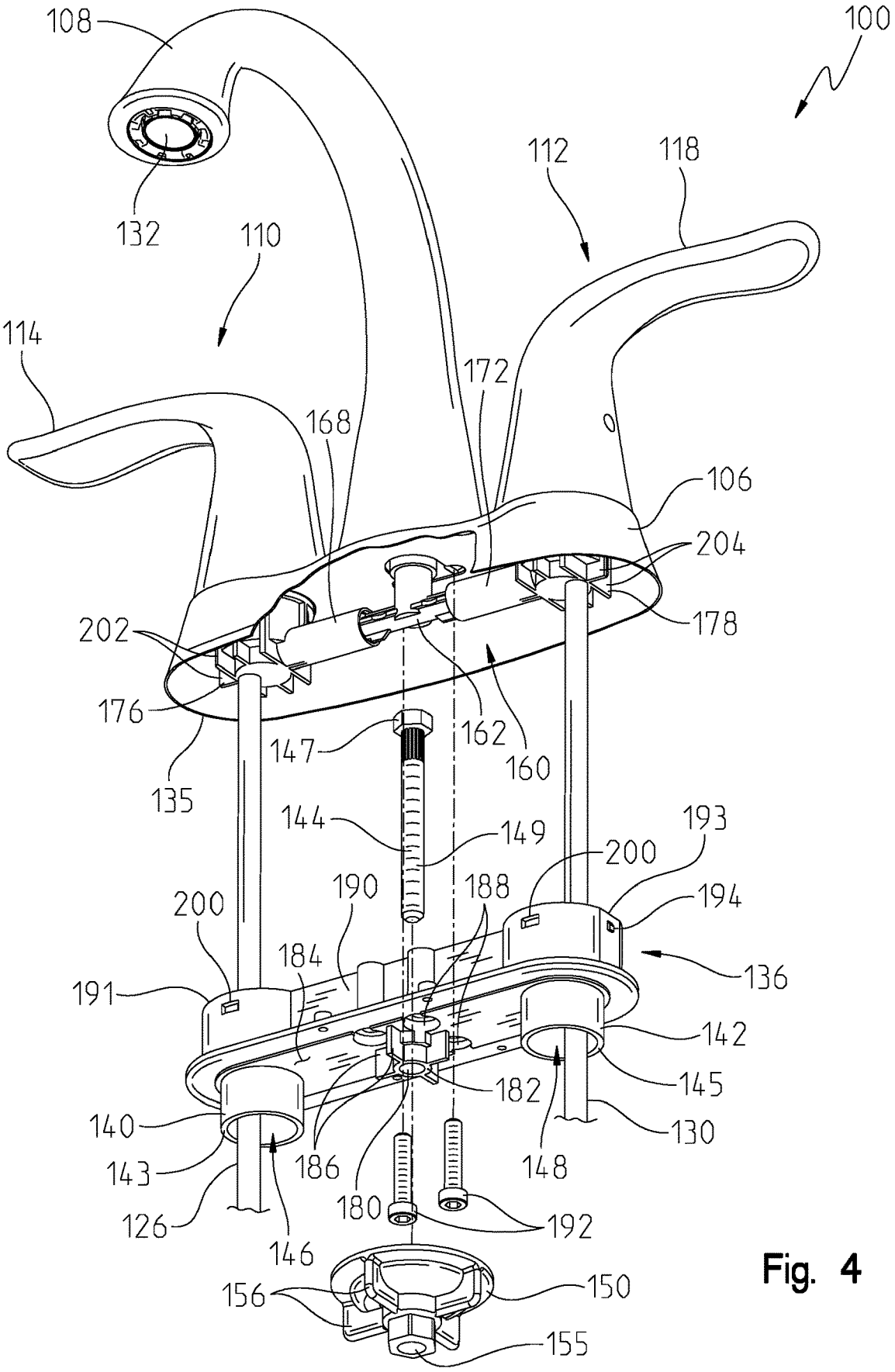
FIG. 4 is a first exploded bottom perspective view of the faucet assembly of FIG. 2, with a partial cut-away of the escutcheon.
Figure 5:
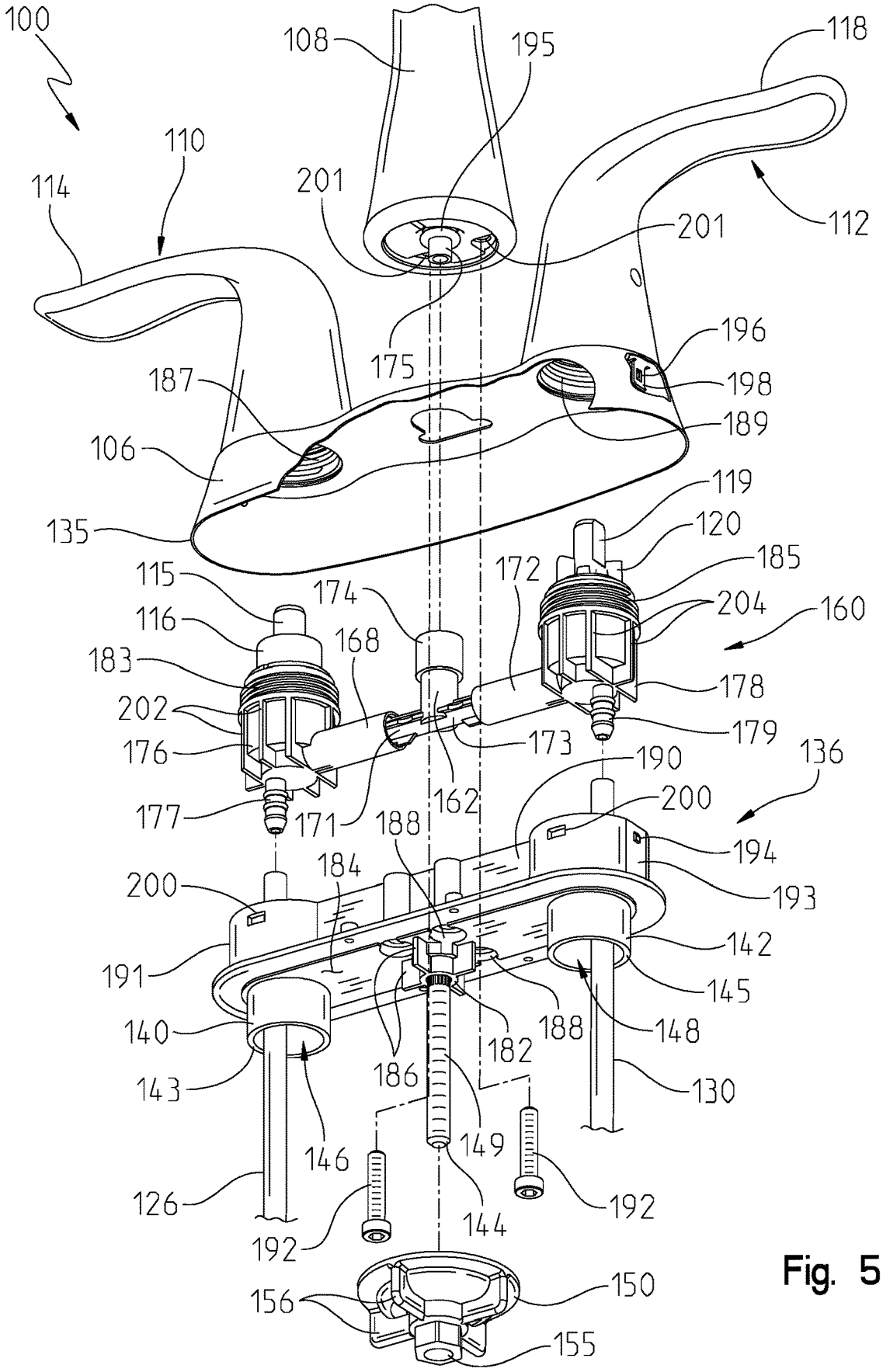
FIG. 5 is a second exploded bottom perspective view of the faucet assembly of FIG. 2, with a partial cut-away of the escutcheon.

Now referring to FIGS. 3-5, a molded waterway assembly 160 is illustratively formed of a polymer and cooperates with the mounting base 136, so that the waterway assembly 160 is received between the escutcheon 106 and the mounting base 136 when assembled. The waterway assembly 160 may form the shape of an inverted "T", wherein a crossbar portion 162 serves to mix fluid from each of the first valve cartridge 116 operably coupled to the first handle 114 and fluidly coupled to the first fluid source 124, and the second valve cartridge 120 operably coupled to the second handle 118 and fluidly coupled to the second fluid source 128 during operation.

With further reference to FIGS. 3-5, the crossbar portion 162 is fluidly coupled to the first valve cartridge 116 via a first valve pipe 168, wherein a seal 170 (e.g., an o-ring in FIG. 3) may be positioned between a first arm 171 of the crossbar portion 162 and the first valve pipe 168 to ensure a fluid-tight connection. A first valve holder or valve body 176 sealingly receives the first valve cartridge 116 and includes a downwardly extending connecting tube 177, illustratively a barbed fitting, for fluidly coupling with the pipe 126 (FIG. 5). The valve pipe 126 and the valve holder 176 may be formed of a polymer as separate components or integrally formed (e.g., molded together as a single piece). The crossbar portion 162 is fluidly coupled to the second valve cartridge 120 via a second valve pipe 172, wherein a seal 174 (e.g., an o-ring in FIG. 3) may be positioned between a second arm 173 of the crossbar portion 162 and the second valve pipe 172 to ensure a fluid-tight connection. A second valve holder or valve body 178 sealingly receives the second valve cartridge 120 and includes a downwardly extending connecting tube 179, illustratively a barbed fitting, for fluidly coupling with the pipe 130 (FIG. 5). The valve pipe 172 and the valve holder 178 may be formed as a polymer as separate components or integrally formed (e.g., molded together as a single piece).

Illustratively, the valve holders 176 and 178 each include external threads 183 and 185 configured to threadably engage with bonnet nuts 187 and 189, respectively. More particularly, the bonnet nuts 187 and 189 secure the valve cartridges 116 and 120 within the respective valve holders 176 and 178. The crossbar portion 162 is fluidly coupled to a spout tube 175 which delivers fluid from the crossbar portion 162 to the outlet 132 of the spout 108 (FIG. 5). Illustratively, the spout tube 175 may be formed of a polymer, such as a cross-linked polyethylene (PEX). A seal 195 (such as an o-ring) may be operably coupled to the tube 175 fluidly sealing with the crossbar portion 162.

Figure 6:
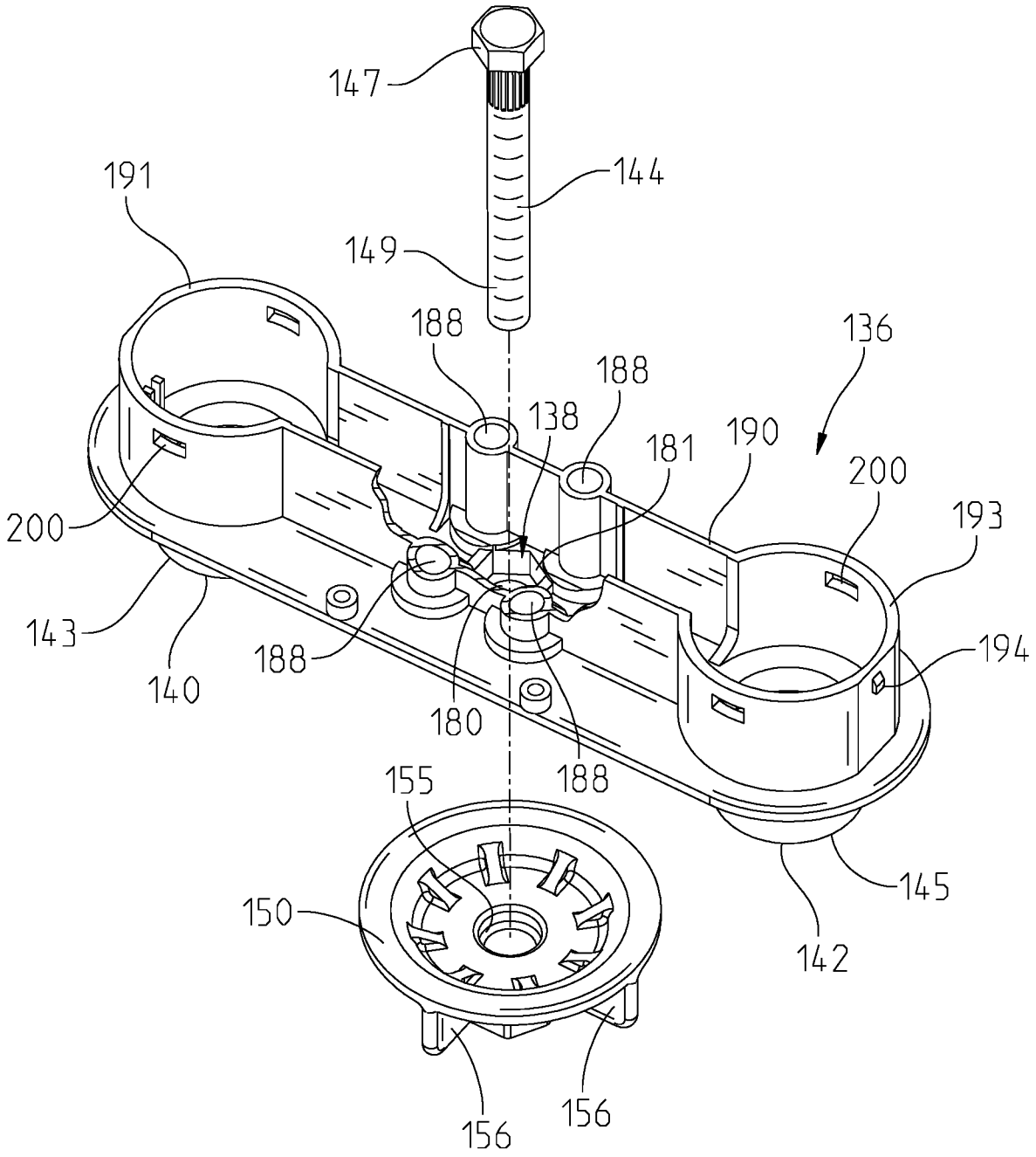
FIG. 6 is an exploded perspective view of the mounting base and accompanying mounting hardware of FIG. 2.
Figure 7:
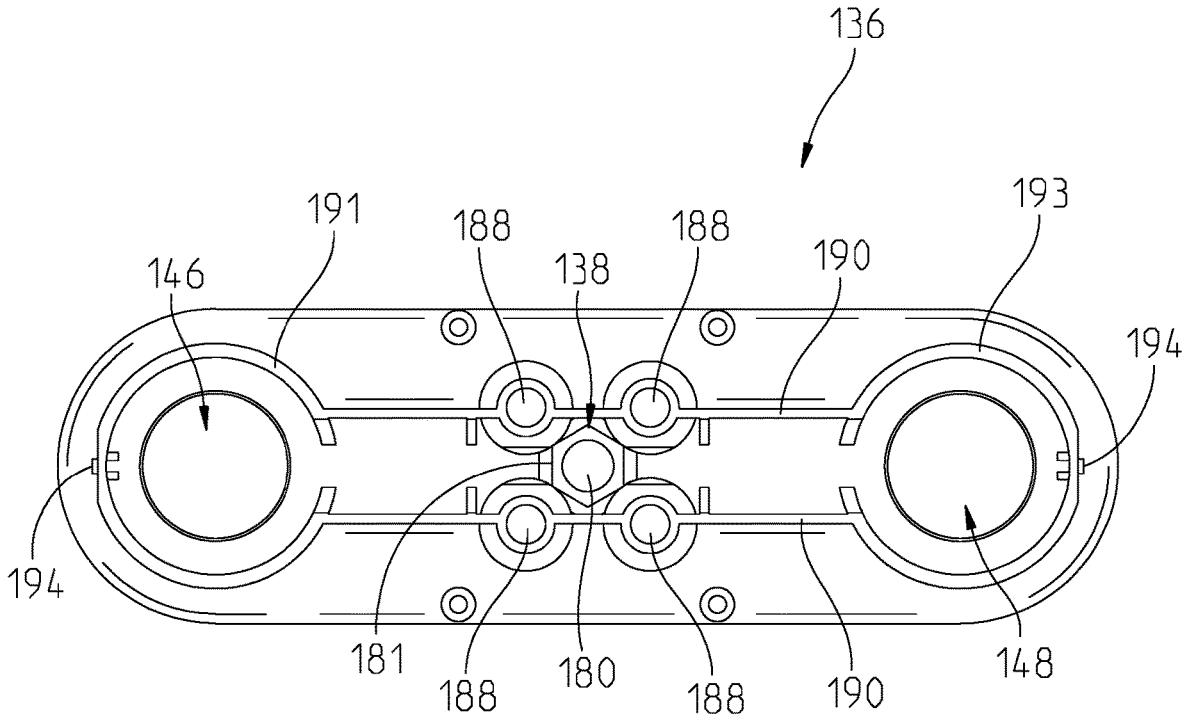
FIG. 7 is a top plan view of the mounting base of the faucet assembly of FIG. 1.

Referring additionally to FIG. 6, the illustrative mounting base 136 includes the retention cavity 138 intermediate the first locating member 140 and the second locating member 142, wherein the retention cavity 138 defines a through hole 180 and a counterbore 181 for receiving the center mounting fastener 144. Illustratively, the proximal head 147 of the fastener 144 is received within the counterbore 181 and includes a shape (e.g., hexagonal) cooperating with the counterbore 181 to prevent rotation therebetween. The threaded shaft 149 of the fastener 144 is illustratively received within the through hole 180. With reference to FIG. 4, the through hole 180 includes a sidewall 182, which extends below a bottom surface 184 of the mounting base 136 and includes a plurality of extensions 186 extending radially outwardly from the sidewall 182 to facilitate positioning of the faucet assembly 100 relative to the mounting deck 102 as described further herein, and to provide support to the through hole 180, the retention cavity 138, and the center mounting fastener 150 when assembled.

Illustratively, a plurality of coupling apertures 188 surround the retention cavity 138 within the sidewalls 190 of the mounting base 136 for receiving fasteners 192 (FIG. 4) to facilitate coupling of the escutcheon 106 and the mounting base 136 with the waterway assembly 160 positioned therebetween. Additionally, each of the first locating member 140 and the second locating member 142 include upwardly extending sidewalls 191 and 193, each having a coupling tab 194. Tabs 194 correspond with openings 196 formed within tabs 198 positioned on an interior surface of the escutcheon 106 to facilitate coupling of the escutcheon 106 to the mounting base 136 (FIG. 5). Openings 200, such as slots, may be formed within the sidewalls 191 and 193 to cooperate with tabs (not shown) in the valve holders 176 and 178, Referring further to FIGS. 3-5, at least two fasteners 192 are disposed through corresponding coupling apertures 188 within the sidewalls 190 of the mounting base 136 and received within corresponding recesses 201 of the spout 108 upon assembly. In some embodiments, fasteners 192 may be positioned through all four shown coupling apertures 188 or different coupling apertures 188 to be received within corresponding recesses 201, which may be otherwise positioned within the spout 108 or the escutcheon 106.

A plurality of ridges 202 may extend outwardly from the first valve holder 176, wherein the first valve holder 176 is positioned beneath the first handle 114 and configured to support the first valve cartridge 116. A plurality of ridges 204 may also extend outwardly from a second valve holder 178, which is positioned beneath the second handle 118 and configured to support the second valve cartridge 120. The ridges 202 and 204 facilitate alignment and proper placement of the valve holders 176 and 178 within the corresponding sidewalls 191 and 193 of the mounting base 136.

During assembly, the first source pipe 126 is disposed through the first locating member 140 of the mounting base 136 and fluidly coupled to the first valve cartridge 116 of the first valve assembly 110. The second source pipe 130 is disposed through the second locating member 142 of the mounting base 136 and fluidly coupled to the second valve cartridge 120 of the second valve assembly 112. The center mounting fastener 144 is disposed through the through hole 180 of the retention cavity 138 of the mounting base 136. The mounting base 136 is positioned within the sidewall 135 of the escutcheon 106 so that the ridges 202 of the first valve holder 176 and the ridges 204 of the second valve holder 178 are received within the sidewalls 191 and 193 of the first locating member 140 and the second locating member 142, respectively, so that the ridges facilitate a snug fit between each of the valve holders 176 and 178 and the respective locating members 140 and 142. The tabs 194 of the mounting base 136 are received within openings 196 of the escutcheon 106. The fasteners 192 are then disposed through the escutcheon 106 and received by the recesses 201 of the spout 108. When coupled, the head 147 of the center mounting fastener 144 sits just below the crossbar portion 162 of the waterway assembly 160.

The faucet assembly 100 is positioned relative to the mounting deck 102 by aligning the first locating member 140, the second locating member 142 and the through hole sidewalls 182 and corresponding extensions 186 with mounting holes in the mounting deck 102. As shown in FIG. 3, the mounting deck 102 has three mounting holes: a first locating mounting hole 210, a second locating mounting hole 212, and a center mounting hole 214. The faucet assembly 100 is aligned with the mounting deck 102 by positioning the first locating member 140 in alignment with the first locating mounting hole 210, positioning the second locating member 142 in alignment with the second locating mounting hole 212, and positioning the through hole 180 and center mounting fastener 144 in alignment with the center mounting hole 214.

The mounting deck 102 receives the faucet assembly 100 as shown in FIG. 3, wherein the first locating mounting hole 210 receives the first locating member 140, the second locating mounting hole 212 receives the second locating member 142, and the center mounting hole 214 receives the center mounting fastener 144, the sidewall 182 of the through hole 180, and the corresponding extensions 186. The extensions 186 ensure proper positioning of the center mounting fastener 144 within the center mounting hole 214 in addition to the benefits provided above. The center mounting nut 150 is coupled to the center mounting fastener 144 and tightened about the center mounting fastener 144 to secure the faucet assembly 100 to the mounting deck 102.

Figure 8:
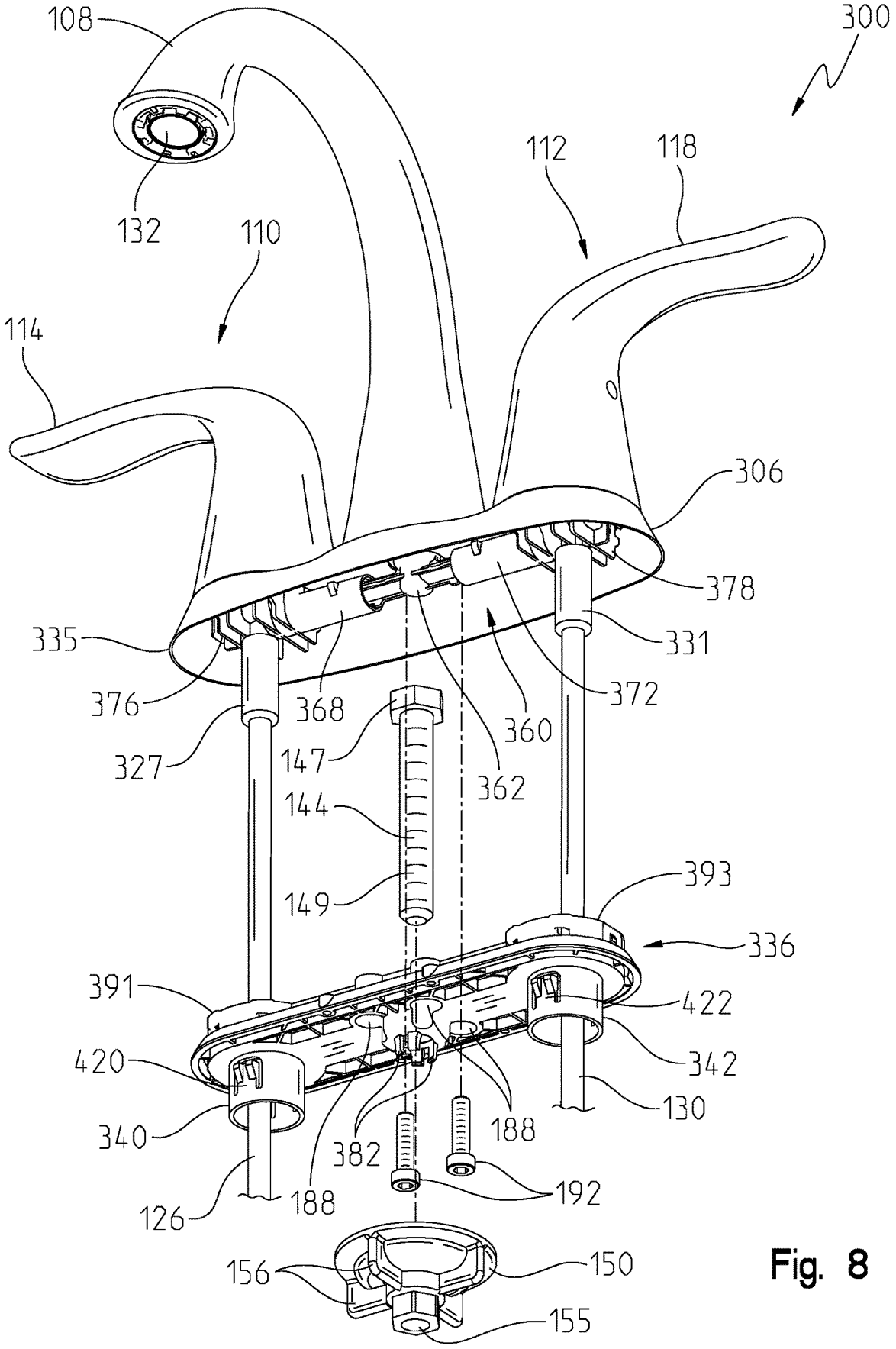
FIG. 8 is a first exploded bottom perspective view of a further illustrative faucet assembly of the present disclosure, including a view of a mounting base and accompanying mounting hardware for mounting the faucet assembly to a mounting deck.
Figure 9:
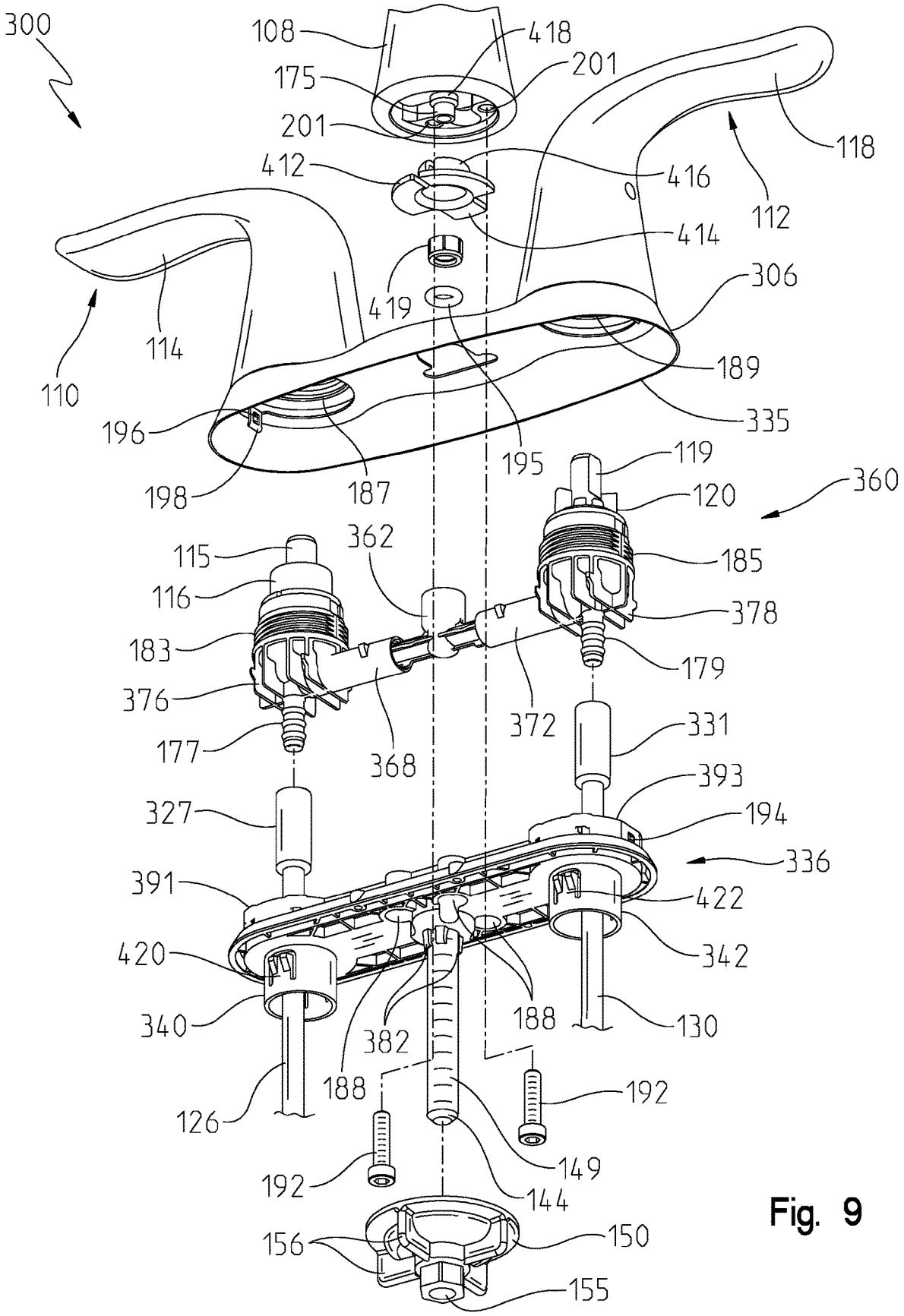
FIG. 9 is a second exploded bottom perspective view of the faucet assembly of FIG. 8, including a view of the mounting base and a waterway assembly.

With reference now to FIGS. 8 and 9, a further illustrative faucet assembly 300 is shown. The illustrative faucet assembly 300 includes many features similar to the faucet assembly 100 detailed above in connection with FIGS. 1-7. In the following description, like reference numbers are used to identify similar components between illustrative faucet assemblies 100 and 300.

Figure 10:
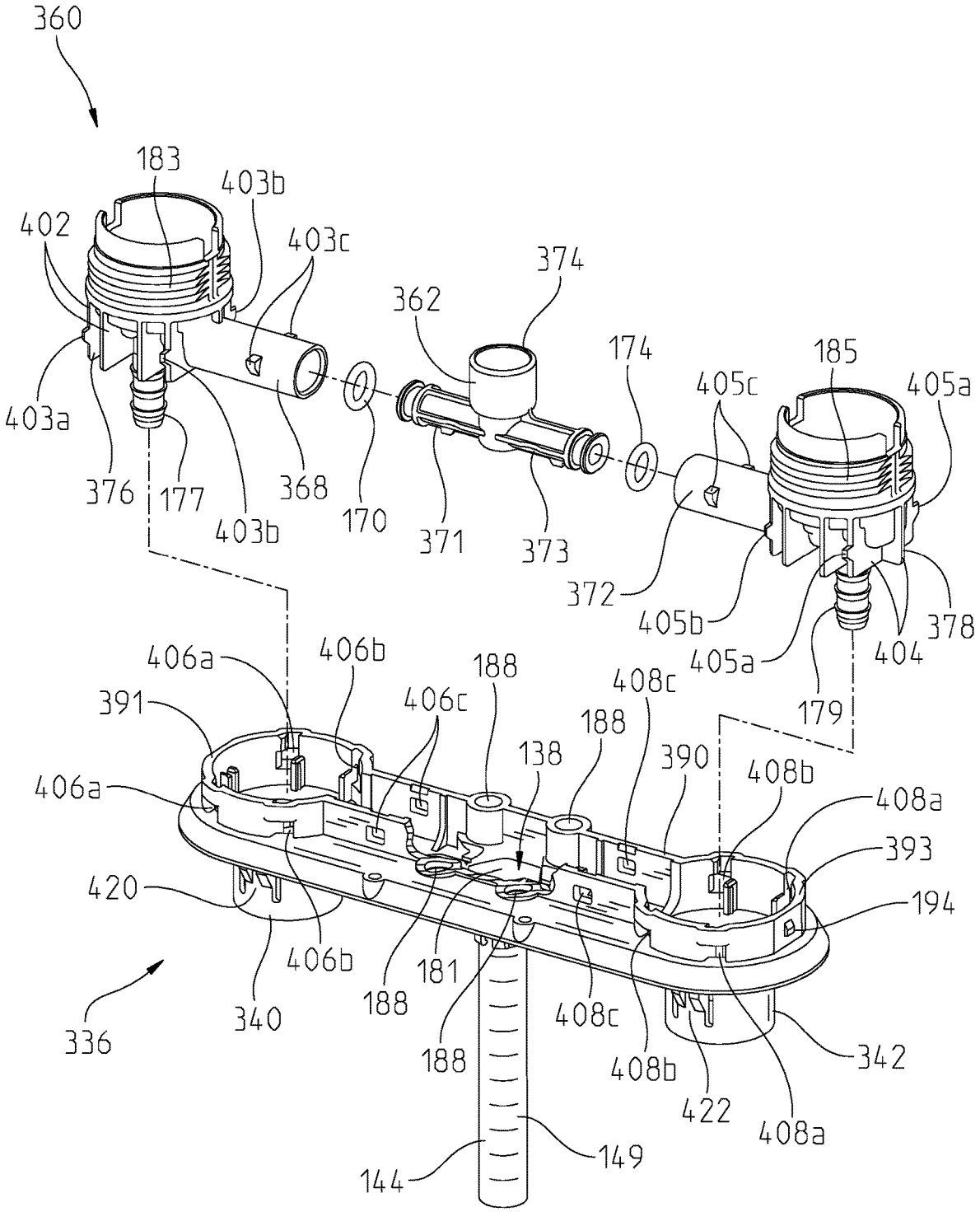
FIG. 10 is an exploded perspective view of the mounting base and the waterway assembly of FIG. 8.

The illustrative faucet assembly 300 includes the spout 108, the first valve assembly 110, the second valve assembly 112 and an escutcheon 306. The escutcheon 306 illustratively includes a sidewall 335 configured to receive a mounting base 336. The escutcheon 306 may be formed of a metal, such as stamped brass or stainless steel. The illustrative mounting base 336 includes a center retention cavity 138 positioned intermediate a first locating member 340 and a second locating member 342 (FIG. 10). The head 147 of the mounting fastener 144 is received within the recess 138.

Figure 11:
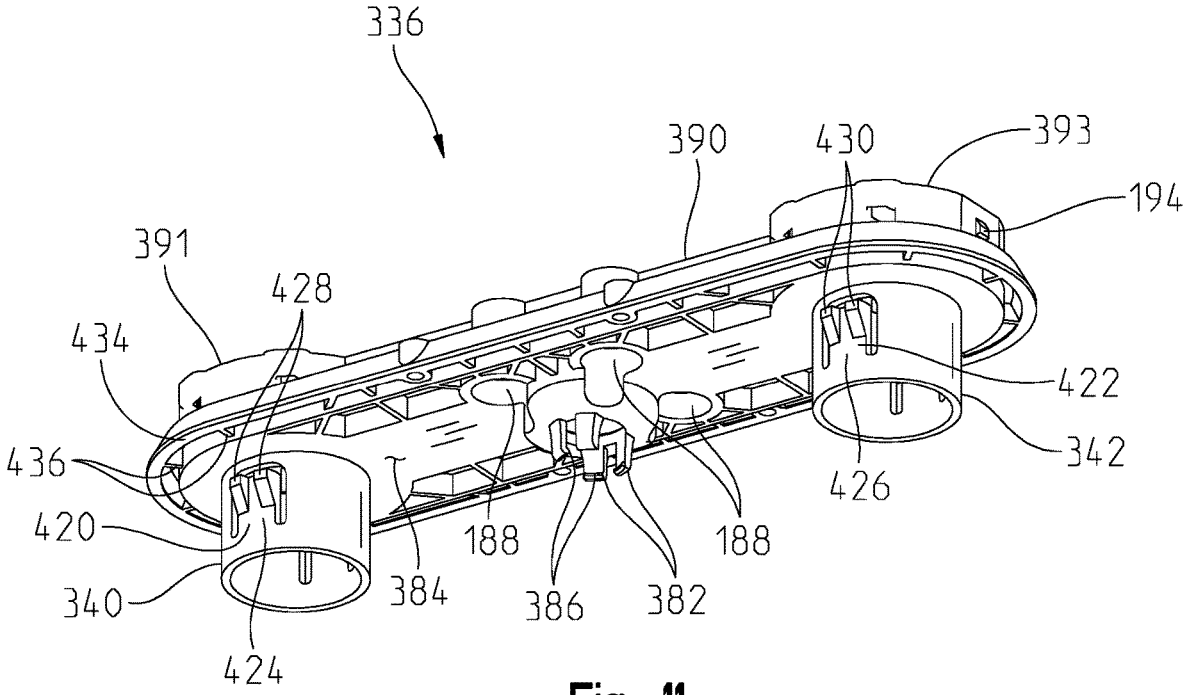
FIG. 11 is a bottom perspective view of the mounting base of FIG. 8.

With reference to FIGS. 9-11, a molded waterway assembly 360 is illustratively formed of a polymer and cooperates with the mounting base 336, so that the waterway assembly 360 is positioned between the escutcheon 306 and the mounting base 336. The waterway assembly 360 may form the shape of an inverted "T", wherein a crossbar portion 362 serves to mix fluid from each of the first valve cartridge 116 operatively coupled to the first handle 114 and fluidly coupled to the first fluid source 124, and the second valve cartridge 120 operably coupled to the second handle 118 and fluidly coupled to the second fluid source 128 during operation.

Figure 12:
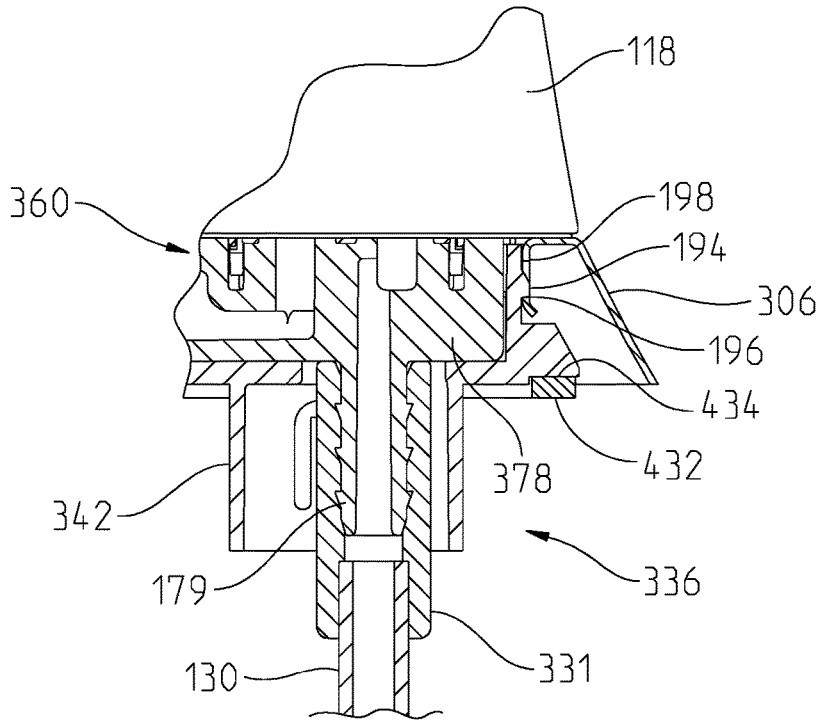
FIG. 12 is a partial cross-sectional view at an end of the faucet assembly of FIG. 8 showing an interface between the escutcheon, the mounting base and the waterway assembly.
Figure 13:
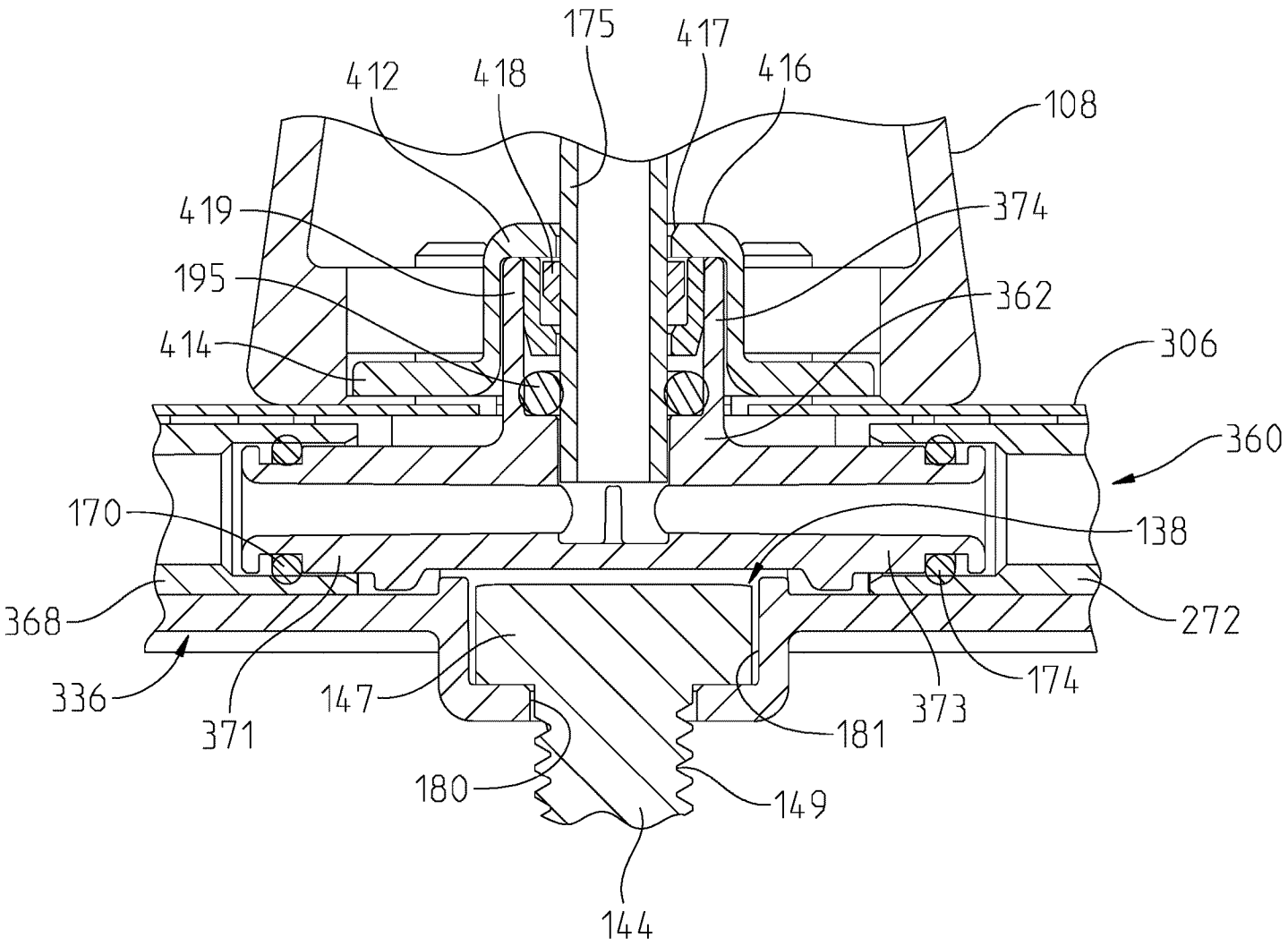
FIG. 13 is a partial cross-sectional view at a center of the faucet assembly of FIG. 8 showing an interface between the spout, the escutcheon, the mounting base, the waterway assembly and the mounting fastener.

With reference to FIGS. 10, 12 and 13, the crossbar portion 362 is fluidly coupled to the first valve cartridge 116 via a first valve pipe 368, wherein the seal 170 (e.g., an o-ring in FIGS. 10 and 13) may be positioned between a first arm 371 of the crossbar portion 362 and the first valve pipe 368 to ensure a fluid-tight connection. A valve holder or a valve body 376 sealingly engages the first valve cartridge 116 and includes the downwardly extending connecting tube 177, illustratively a barbed fitting, for fluidly coupling with the valve pipe 126. The valve pipe 126 and the valve holder 376 may be formed of a polymer as separate components or integrally formed (e.g., molded together as a single piece). The cross bar portion 362 is fluidly coupled to the second valve cartridge 120 via a second valve pipe 372, wherein a seal 174 (e.g., o-ring in FIGS. 10 and 13) may be positioned between a second arm 373 and the crossbar portion 362 and the second valve pipe 372 to ensure a fluid-type connection. A valve holder or valve body 178 sealingly receives the second valve cartridge 120 and includes a downwardly extending connecting tube 179, illustratively a barbed fitting, for fluidly coupling with the pipe 130. The valve pipe 372 and the valve holder 378 may be formed of a polymer as separate components or integrally formed (e.g., molded together as a single piece).

The crossbar portion 362 is fluidly coupled to the spout tube 175 which delivers fluid from the cross bar portion 362 to the outlet 132 of the spout 108 (FIGS. 8 and 9). O-ring seal 195 may be operably coupled to the tube 175 for fluidly sealing with the crossbar portion 362. Illustratively, the proximal head 147 of the mounting fastener 144 is received within a counterbore 181 and includes a shape (e.g., hexagonal) cooperating with the counterbore 181 to prevent rotation therebetween (FIGS. 10 and 13). The threaded shaft 129 of the fastener 144 is illustratively and received within the through hole 180. A plurality of downwardly extending resilient snap fingers 382 extend downwardly from a lower surface 384 of the mounting base 336 and are configured to retain the mounting bolt 144 to the mounting base 336. More particularly, each finger 382 includes an inwardly extending lip 386 which engages threads of the threaded shaft 149 to help retain the mounting fastener 144 from moving upwardly unintentionally prior to final assembly (FIG. 11).

With reference to FIGS. 9 and 10, the plurality of coupling apertures 188 illustratively surround the retention cavity 138 within the sidewalls 390 of the mounting base 336 for receiving fasteners 192 to facilitate coupling of the escutcheon 306 and the mounting base 336 to the waterway assembly 360 positioned therebetween. Illustratively, the first locating member 340 and the second locating member 342 include upwardly extending sidewalls 391 and 393, each including a coupling tab 194. Tabs 194 correspond with openings 196 formed within tabs 198 positioned on an interior surface of the escutcheon 306 to facilitate coupling the escutcheon 306 to the mounting base 336 (FIG. 9). Recesses 406, such as openings defining undercuts, are formed within the mounting base 336 to facilitate coupling of the mounting base 336 to the waterway assembly 360. More particularly, tabs 403*a*, 403*b*, 403*c* and 405*a*, 405*b* and 405*c* of the waterway assembly 360 cooperate with openings 406*a*, 406*b*, 406*c* and 408*a*, 408*b* and 408*c* of the mounting base 336, respectively.

Referring further to FIGS. 8 and 9, at least two fasteners 192 are disposed through corresponding coupling apertures 188 within the sidewalls 390 of the mounting base 336 and received within corresponding recesses 201 of the spout 108 upon assembly. In some embodiments, fasteners 192 may be positioned in all four shown coupling apertures 188 or different coupling apertures 188 to be received within corresponding recesses 201, which may be otherwise positioned within the spout 108 or the escutcheon 106.

As shown in FIG. 10, a plurality of ridges 402 may extend outwardly from the first valve holder 376, wherein the first valve holder 376 is positioned beneath the first handle 114 and configured to support the first valve cartridge 116. A plurality of ridges 404 may also extend outwardly from the second valve holder 378, which is positioned beneath the second handle 118 and configured to support the second valve cartridge 120. The ridges 402 and 404 facilitate proper alignment and proper placement of the valve holders 376 and 378 within the corresponding sidewalls 191 and 193 of the mounting base 336.

With further reference to FIG. 9, a tube retainer 412 is illustratively received intermediate the escutcheon 306 and the spout 108 and cooperates with the spout tube 175 to axially retain the tube 175 relative to the escutcheon 306. The tube retainer 412 may include a base or flange 414 and an upwardly extending cap 416 defining an opening 417 receiving the spout tube 175. An annular ring or ferrule 418 is illustratively formed proximate the end of the tube 175. In one illustrative embodiment, the ferrule 418 may be a polymer overmolded with the tube 175 to define a single unitary component (e.g., PEX). The ferrule 418 is illustratively captured between a retainer cup 419 and the cap 416 of the tube retainer 412 to axially restrain the tube 175.

Spring fingers 420 and 422 are illustratively formed in the first locating member 340 and the second locating member 342 of the mounting base 336. More particularly, each locating member 340, 342 includes a pair of diametrically opposed spring fingers 420 and 422, respectively. The spring fingers 420 and 422 include a outwardly biased tab or base supporting 424 and 426 supporting a pair of angled tabs or projections 428 and 430. The spring fingers 420 and 422 accommodate slack in the mounting holes 210, 212 of the deck 102 and facilitate a secure fit.

With reference to FIGS. 11 and 12, a deck seal 432 may be received between the mounting base 336 and the upper surface 152 of the mounting deck 102. The deck seal 432 may be an elastomeric gasket preventing rotation between the mounting base 336 and the mounting deck 102. The mounting base 336 may include a peripheral rim 434 and connecting ribs 436 to help secure the deck seal 432 to the mounting base 336.

The mounting assembly structure and method as described can be used alternatively to the conventional methods of using two or more mounting shanks to mount faucet assemblies having two handles. The mounting assembly structure and method as described offers a quicker and easier installation of the faucet assembly to the mounting deck by requiring only a single fastening mechanism without sacrificing security, and, in fact, improving security through the use of the first locating member, the second locating member, and the sidewall and the corresponding extensions of the through hole in conjunction with the mounting holes of the mounting deck.

As used in this patent application, the terminology "for example," "for instance," "like," "such as," "comprising," "having," "including," and the like, when used with a listing of one or more elements, is open-ended, meaning that the listing does not exclude additional elements. Likewise, when preceding an element, the articles "a," "an," "the," and "said" mean that there are one or more of the elements. Moreover, directional words such as front, rear, top, bottom, upper, lower, radial, circumferential, axial, lateral, longitudinal, vertical, horizontal, transverse, and/or the like are employed by way of example and not limitation. As used herein, the term "may" is an expedient merely to indicate optionality, for instance, of an element, feature, or other thing, and cannot be reasonably construed as rendering indefinite any disclosure herein. Other terms are to be interpreted and construed in the broadest reasonable manner in accordance with their ordinary and customary meaning in the art, unless the terms are used in a context that requires a different interpretation.

Finally, the present disclosure is not a definitive presentation of an invention claimed in this patent application but is merely a presentation of examples of illustrative embodiments of the claimed invention. More specifically, the present disclosure sets forth one or more examples that are not limitations on the scope of the claimed invention or on terminology used in the accompanying claims, except where terminology is expressly defined herein. And although the present disclosure sets forth a limited number of examples, many other examples may exist now or are yet to be discovered and, thus, it is neither intended nor possible to disclose all possible manifestations of the claimed invention. In fact, various equivalents will become apparent to artisans of ordinary skill in view of the present disclosure and will fall within the spirit and broad scope of the accompanying claims. Features of various implementing embodiments may be combined to form further embodiments of the invention. Therefore, the claimed invention is not limited to the particular examples of illustrative embodiments disclosed herein but, instead, is defined by the accompanying claims.

What is claimed is:

1. A faucet assembly, comprising:

an escutcheon;

a first handle rotatably supported above the escutcheon;

a second handle rotatably supported above the escutcheon in spaced relation to the first handle;

a spout extending above the escutcheon intermediate the first handle and the second handle;

a mounting fastener including a proximal fastener head and a distal fastener shaft, the fastener head received within an interior space of the escutcheon, and the fastener shaft being a threaded shaft extending below the escutcheon;

a retainer defined by the faucet assembly and coupled to the fastener head to prevent rotation between the escutcheon and the threaded shaft of the mounting fastener; and a waterway assembly received within the escutcheon, the waterway assembly configured to deliver fluid from a first valve operably coupled to the first handle to the spout, and from a second valve operably coupled to the second handle to the spout;

wherein the threaded shaft of the mounting fastener is configured to couple to a mounting nut to secure the faucet assembly to a mounting deck during installation.

2. The faucet assembly of claim 1, further comprising a mounting base removably coupled to the escutcheon, the mounting base including a retention cavity defining a through hole for receiving the mounting fastener so that the mounting fastener extends below the mounting base.

3. The faucet assembly of claim 2, further comprising a first locating member corresponding to the first handle and a second locating member corresponding to the second handle, wherein the first locating member and the second locating member extend below the mounting base to be received by the mounting deck during installation.

4. The faucet assembly of claim 1, wherein the retainer is positioned intermediate of the first handle and the second handle.

5. The faucet assembly of claim 1, wherein the waterway assembly is additionally configured to facilitate mixture of the fluid from the first valve with fluid from the second valve to form a combined fluid and deliver the combined fluid to the spout.

6. The faucet assembly of claim 1, wherein the mounting nut includes gripping tabs to facilitate the rotational securement of the mounting nut to the threaded shaft of the mounting fastener.

7. A faucet assembly, comprising:

an escutcheon;

a first handle rotatably supported above the escutcheon;

a second handle rotatably supported above the escutcheon in spaced relation to the first handle;

a spout extending above the escutcheon intermediate the first handle and the second handle;

a mounting fastener including a proximal fastener head and a distal fastener shaft, the fastener head received within an interior space of the escutcheon, and the fastener shaft extending below the escutcheon;

a retainer coupled to the fastener head to prevent rotation between the escutcheon and the mounting fastener;

a waterway assembly received within the escutcheon, the waterway assembly configured to deliver fluid from a first valve operably coupled to the first handle to the spout, and from a second valve operably coupled to the second handle to the spout;

wherein the mounting fastener is configured to couple to a mounting nut to secure the faucet assembly to a mounting deck during installation; and a mounting base removably coupled to the escutcheon, the mounting base including a retention cavity defining a through hole for receiving the mounting fastener so that the mounting fastener extends below the mounting base;

wherein the retainer is defined by the retention cavity, and the fastener head is received within the retention cavity to prevent rotation therebetween.

8. A faucet assembly, comprising:

an escutcheon;

a first handle rotatably supported above the escutcheon;

a second handle rotatably supported above the escutcheon in spaced relation to the first handle;

a spout extending above the escutcheon intermediate the first handle and the second handle;

a mounting fastener including a proximal fastener head and a distal fastener shaft, the fastener head received within an interior space of the escutcheon, and the fastener shaft extending below the escutcheon;

a retainer coupled to the fastener head to prevent rotation between the escutcheon and the mounting fastener;

a waterway assembly received within the escutcheon, the waterway assembly configured to deliver fluid from a first valve operably coupled to the first handle to the spout, and from a second valve operably coupled to the second handle to the spout;

wherein the mounting fastener is configured to couple to a mounting nut to secure the faucet assembly to a mounting deck during installation;

a mounting base removably coupled to the escutcheon, the mounting base including a retention cavity defining a through hole for receiving the mounting fastener so that the mounting fastener extends below the mounting base; and at least one locating aperture positioned within a sidewall of the mounting base, at least one recess defined by the escutcheon corresponding with the at least one locating aperture, and at least one locating pin configured to be received within the at least one locating aperture and the at least one recess.

9. The faucet assembly of claim 8, wherein the at least one locating aperture comprises a plurality of locating apertures positioned within a sidewall of the mounting base, a plurality of recesses defined by the escutcheon, each of the plurality of recesses corresponding with a locating aperture, and at least two locating pins, each of the locating pins configured to be received within one of the plurality of locating apertures and one of the plurality of recesses.

10. A faucet assembly, comprising:

an escutcheon;

a first handle rotatably supported above the escutcheon;

a second handle rotatably supported above the escutcheon in spaced relation to the first handle;

a spout extending above the escutcheon intermediate the first handle and the second handle;

a mounting fastener including a proximal fastener head and a distal fastener shaft, the fastener head received within an interior space of the escutcheon, and the fastener shaft extending below the escutcheon;

a retainer coupled to the fastener head to prevent rotation between the escutcheon and the mounting fastener;

a waterway assembly received within the escutcheon, the waterway assembly configured to deliver fluid from a first valve operably coupled to the first handle to the spout, and from a second valve operably coupled to the second handle to the spout;

wherein the mounting fastener is configured to couple to a mounting nut to secure the faucet assembly to a mounting deck during installation; and a mounting base removably coupled to the escutcheon, the mounting base including a retention cavity defining a through hole for receiving the mounting fastener so that the mounting fastener extends below the mounting base;

wherein a sidewall of the through hole extends below the mounting base, the sidewall including a plurality of extensions extending outwardly therefrom.

* * * * *